United States Patent [19]

Foscarini et al.

[11] 4,241,543

[45] Dec. 30, 1980

[54] METHOD OF INSTALLING MANHOLE SAFETY STEPS AND PLUGS THEREFOR

[76] Inventors: Anthony Foscarini; John Foscarini; Corrado Comello, all of 17 Malley Rd., Scarborough, Ontario, M1L 2E4, Canada

[21] Appl. No.: 7,672

[22] Filed: Jan. 30, 1979

[30] Foreign Application Priority Data

Dec. 20, 1978 [CA] Canada ..... 318,298

[51] Int. Cl.[3] ..... E02D 29/12

[52] U.S. Cl. ..... 50/742; 52/20

[58] Field of Search ..... 52/20, 184, 741, 742, 52/745; 182/92; 264/32, 35

[56] References Cited

U.S. PATENT DOCUMENTS

| | | | |
|---|---|---|---|
| 890,573 | 6/1908 | Phelan | 52/20 |
| 3,374,859 | 3/1968 | Dobert | 52/184 |
| 3,436,051 | 4/1969 | Nakahara | 182/92 |

FOREIGN PATENT DOCUMENTS

| | | | |
|---|---|---|---|
| 676968 | 12/1963 | Canada | 182/92 |
| 956153 | 10/1974 | Canada . | |

*Primary Examiner*—John E. Murtagh

*Attorney, Agent, or Firm*—George H. Riches

[57] ABSTRACT

An improved method of manufacturing a concrete manhole casing and plugs for use therein. The method comprises fabricating a form for the manhole and securing a plurality of retractable arbors on the inside thereof. The arbors are extended through the form and a sealed plug is inserted on the end of each arbor. The concrete is poured into the form; vibrated and compacted. The arbors are withdrawn leaving the sealed plugs in place. The plugs carry a threading on their periphery and a novel locking structure on the inside surface.

12 Claims, 21 Drawing Figures

FIG.9a.
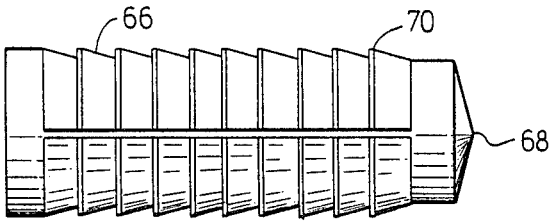
FIG.9b.
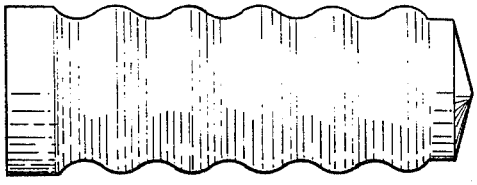
FIG.9c.
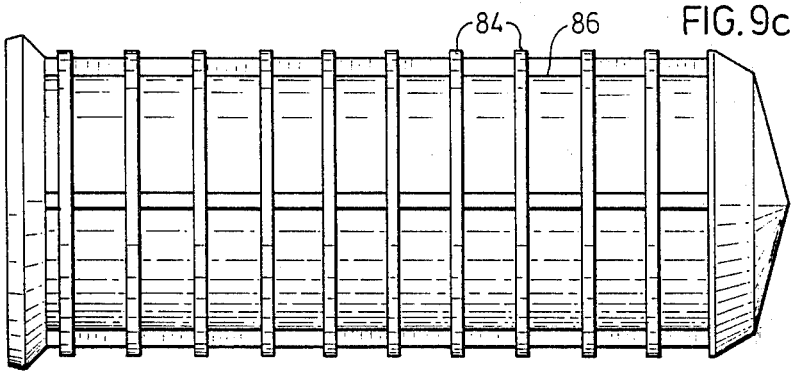
FIG.10a.
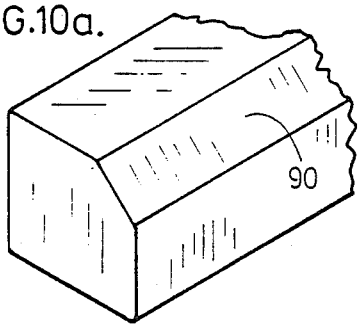
FIG.10b.
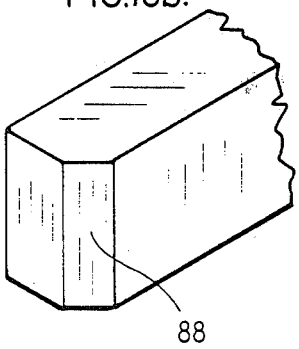
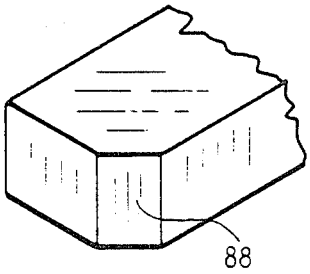
FIG.10c.

METHOD OF INSTALLING MANHOLE SAFETY STEPS AND PLUGS THEREFOR

BACKGROUND OF THE INVENTION

1. Field of the Invention

This invention relates generally to manholes and more particularly, to manhole safety steps, plugs for use therewith and a novel method of constructing manhole casings with the plugs preset therein.

2. Description of the Prior Art

In most road, sewer or other similar construction projects, manholes are installed to provide access to underground areas to allow for the installation, repair or inspection of electrical and/or telephone installations, storm drainage and sanitary sewers and appurtenances and other similar installations, without the need to tear up the road or sidewalk to gain the necessary access.

A typical manhole may be of round or square dimensions with a diameter of between about 42" to 72" and it may extend, for example, from the surface of the ground downwardly to an underground area or interconnecting tunnel which contains electrical or telephone cables, to a sewer conduit or a pumping station. The manhole, usually consists of one or more riser sections, each of which consists of a casing and a top section, and the manhole is set in the ground and earth is backfilled about the casing to secure the casing in the desired position. A removable top or cover may be placed over the casing and a means is provided for access to the interior of the manhole. The casings may be reinforced, if desired.

The casings for the manholes are usually manufactured of concrete of for example 4000 to 6000 psi and may be of any desired length, usually in the range of three feet to six feet. These dimensions may vary depending upon the specifications required for each project. Any number of sections may be used to produce the manhole of the desired length.

For ease of reference, the description of this invention will be made in conjunction with a single riser section. However, it is to be understood that any number of riser sections may be used in the production of a manhole of the desired height. The risers are vertically aligned with each other and secured in any method well-known and familiar to those in this art. For a description of precast concrete manhole sections, reference is made to the Annual Book of ASTM Standards, C478-73, American Society For Testing and Materials (1973).

The method of manufacturing the manhole casing may also vary but usually includes the steps of pouring the concrete into a form, compacting and curing the concrete. This may be done either at a prefabrication site or at the job site. Once the manhole casing is positioned, earth is backfilled about the manhole casing to secure it in the desired location.

In order to allow easy access to the bottom of the manhole, some form of steps must be provided along the interior vertical surface of the casing to allow the workman to climb up or down the manhole. Generally, the steps are either in the form of a portable or removable ladder or steps embedded in the side wall of the manhole casing.

Portable ladders are generally not used in the trade because of the obvious drawback that the workman must carry the ladder with him to each manhole. Also, there is a serious danger that the ladder may dislodge itself during use thus causing the workman to fall.

Manholes with steps provided in the wall of the casing thus have represented an improvement over the use of portable ladders. The steps are permanently and safely secured in the concrete wall of the manhole casing. These steps are generally U-shaped and are placed horizontal with the free ends of each arm embedded in the concrete wall of the manhole casing. The base portion of each step is dropped slightly from the level of the arms to provide an additional safety feature.

In order to secure the arms of the steps in the concrete wall of the casing, various different methods have been suggested by the prior art.

One of these methods of the prior art is to secure the step in place with the form and then to pour the concrete and cure it with the arms of the steps in place. This method is particularly cumbersome in that a complicated form is required and it is difficult to remove the form from the concrete with the steps in place.

More recently, cored holes are formed in the wall of the manhole casing and the arms of the steps are then inserted into the cored holes and grouted into place. This may be done, for example, by drilling holes into the concrete manhole casing and securing the arms of the steps into the drilled hole.

In order to provide a secure fit, it is necessary for these holes to be drilled to exact tolerances. Also, this process is very time consuming and adds considerable cost to the manufacture of the manhole casing.

A further disadvantage with the prior art is that the plugs employed therein do not provide a secure arrangement and the arms of the step may pull loose thus creating a dangerous situation for the workman.

Some of these plugs may well hold the arms of the step in place under normal use. However, they fail when extraordinary pressure is applied to the step. For example, if a workman misses a step with his foot and falls to the next step, a substantially larger amount of pressure is applied to the second or lower step. The step must be able to withstand this sudden and extraordinary pressure applied to it without its arms being pulled from the wall.

One example of the method of securing the plug and the step of the prior art is shown in Canadian Pat. No. 676,968 granted to Marino on Dec. 31, 1963. This patent shows the use of a locking means such as a loose pin to secure the step to an aluminum sleeve which has been grouted into the wall. A serious drawback with this invention is that the locking means (that is, the pin) may be removed or loosened by any person thus creating a potentially dangerous situation for the workman.

A second plug arrangement is shown in Canadian Pat. No. 956,153 granted to Zenhausern on Oct. 15, 1974 which shows a plug inserted into the interior of the wall with the arms of the step inserted into the plug. This arrangement requires the drilling of holes to exact tolerances to insure a good grip for the plug.

SUMMARY OF THE INVENTION

Accordingly, it is an object of the present invention to provide a novel process for installing steps in a manhole casing.

It is a further object of this invention to provide an improved plug for use in securing a step in a manhole casing.

To this end, in one of its aspects, the invention provides a method of manufacturing a concrete manhole casing comprising:

(a) fabricating a form of a predetermined shape;

(b) securing a plurality of retractable arbors on the inside surface of said form, each arbor located on the surface of said form at a predetermined location;

(c) extending each arbor through said form;

(d) placing a plug on the end of each arbor;

(e) pouring concrete into said form;

(f) vibrating and compacting said poured concrete;

(g) retracting said arbor leaving said plug in said compacted concrete; and (h) removing said form and arbors.

In another of its aspects, the invention provides a plug for use in a manhole casing, said plug comprising an elongated body of yieldable plastic having a conical tip and a hollowed interior with a locking means on the interior surface of said plug.

In another of its aspects, the invention provides a method of constructing a manhole comprising:

(a) prefabricating a manhole casing, said prefabrication comprising the steps of:

(i) fabricating a form of a predetermined shape;

(ii) securing a plurality of retractable arbors on the inside surface of said form, each arbor located on the surface on said form at a predetermined location;

(iii) extending each arbor through said form;

(iv) placing a sealed plug on the end of each arbor;

(v) pouring concrete into said form;

(vi) vibrating and compacting said poured concrete;

(vii) retracting said arbors leaving said sealed plugs in said compacted concrete; and (viii) removing said form and arbors;

(b) transporting said prefabricated casing to a job site;

(c) inserting said casing into the ground at a predetermined position; and (d) back filling earth around said casing to secure said manhole casing in the ground.

Further objects and advantages of the invention will appear from the following description taken together with the accompanying drawings.

BRIEF DESCRIPTION OF THE DRAWINGS

FIG. 4 is a sectional view of steps of the present invention wherein

FIGS 9(*a*) to 9(*c*) are side views of plugs of the present invention.

FIGS. 10(*a*) to 10(*c*) are views of the end portions of arbors used in the present invention.

DESCRIPTION OF THE PREFERRED EMBODIMENT

Figure 1:
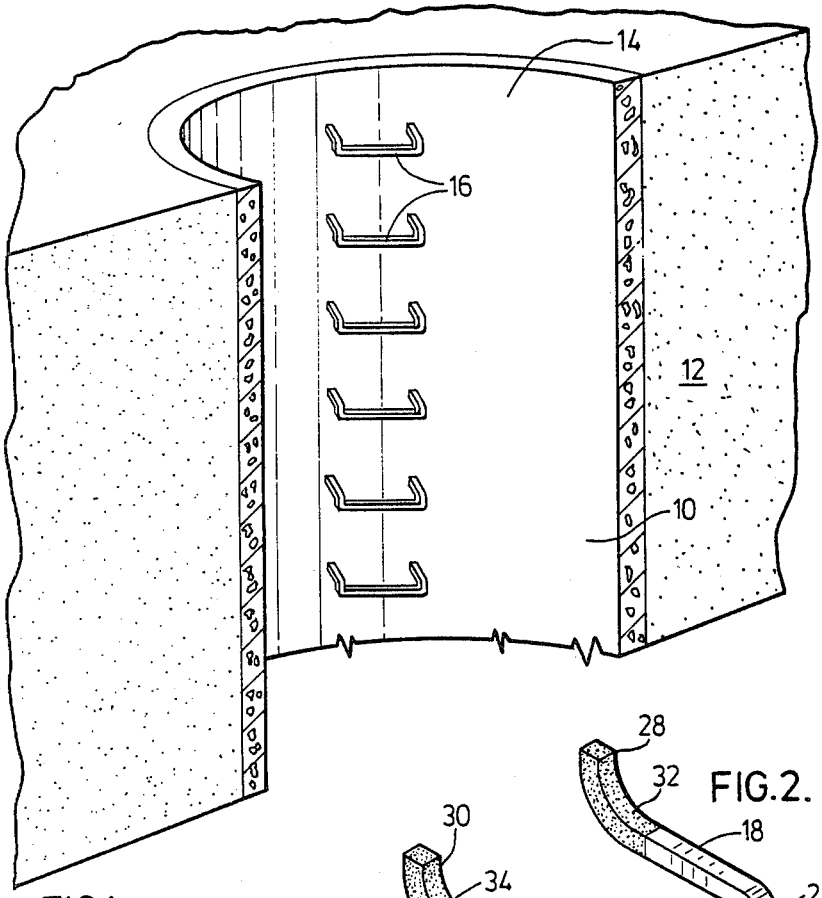
FIG. 1 is a cut-away perspective view of a manhole casing with steps.

As shown in FIG. 1, a manhole casing is generally a cylindrical (or rectangular) body 10 which is set vertically in the ground 12 with the top 14 being open. A cover (not shown) may be placed over the opening 14. Steps 16 are vertically arranged to allow the workman to easily climb up and down the manhole casing 10.

Figure 2:
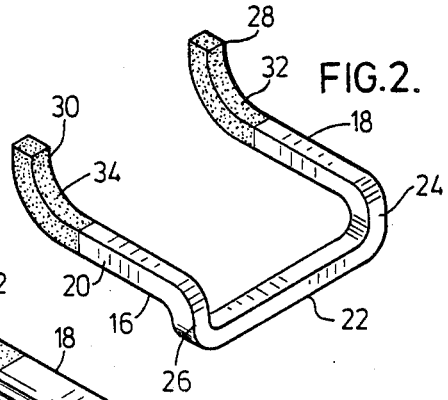
FIG. 2 is a perspective view of a step of the prior art.

FIG. 2 shows a step used in the prior art. The step 16 is usually made of an aluminum alloy although not restricted thereto, and comprises a pair of arms 18, 20 and a base 22 which is disposed marginally below the plane of the arms 18, 20 by bending the connecting portions 24, 26. The free end of each arm 18, 20 is bent upwards to form hooked portions 28, 30. A coating is applied to the end portions 32, 34 of the arms 18, 20 which prevents any interaction between the concrete and the aluminum alloy of the step 16.

The base 22, being disposed lower than the arms 18, 20 provides an additional safety feature. The workman, when standing on the base 22 of the step 16, can feel with his foot, connecting portions 24, 26 and thus, can easily ascertain the position of his feet on base 22.

In the manufacture, the hooked portions 28, 30 were either set in the concrete when it was poured or were inserted into holes produced in the side wall of the manhole casing 10.

Figure 3:
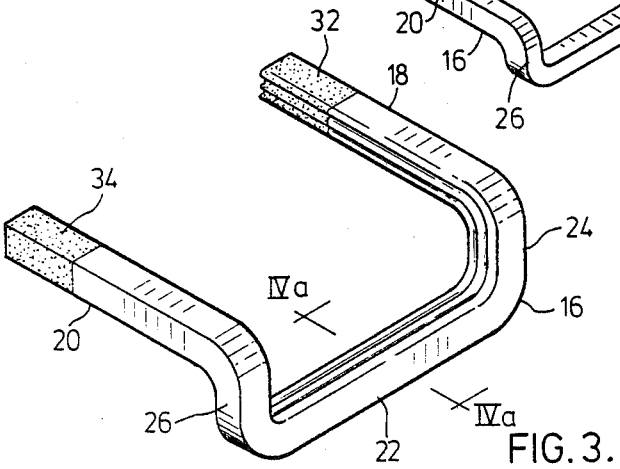
FIG. 3 is a perspective view of a step used in the present invention.
Figure 4A:
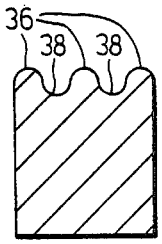
FIG. 4*a* is a sectional view along line IV—IV of FIG. 3, and FIGS. 4(*b*) to 4(*d*) are cross-sectional views of other steps of this invention.
Figure 4B:
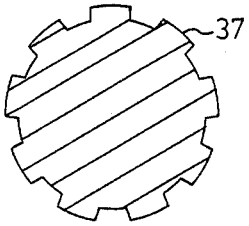
Figure 4C:
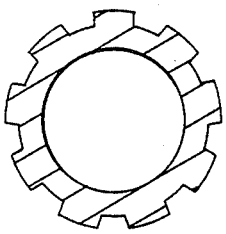
Figure 4D:
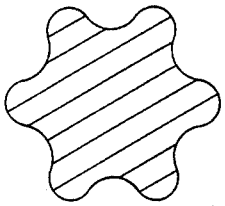

The steps of the present invention, an example of which is shown in FIG. 3, do not have hooked portions 28, 30 but the arms 18, 20 extend horizontally. The steps may be of any desired cross-sectional shape, for example, rectangular, square, circular, polygonal or fluted in cross-section, and may be hollow or solid.

Examples of several of these constructions are shown in FIGS. 4(*a*) to 4(*d*). FIG. 4(*a*) shows the cross-sectional configuration of the step as shown in FIG. 3 which has a plurality of alternating ridges 36 and grooves 38 in a corrugation pattern. Other examples include a circular shape with a plurality of ridges 37 (FIG. 4(*b*)), a hollow shape (FIG. 4(*c*)) and a polygonal shape (FIG. 4(*d*)).

The method of the present invention relates to the manufacture of manhole casings wherein a plug is set within the concrete in an efficient yet simple process which has hithertobefore been unknown to the prior art.

The process is most suited for the production environment although it could be employed in an on-site application.

A form is first constructed of the desired shape to produce a manhole casing of predetermined dimensions. A plurality of retractable arbors are secured within the open centre portion of the form at predetermined positions which correspond to holes in the wall of the manhole into which the arms of the step will be inserted, and the arbors are inserted through the form. A plug is placed on the end of each arbor, the open end of the plug being coplanar with the inner wall of the to-be-constructed manhole casing.

The concrete is then poured into the form, and compacted. Once the concrete is compacted, the arbors are retracted thus leaving the plug securely within the concrete manhole casing. The form is then removed and the casing ready for curing.

Once the concrete is cured, the manhole casing is transported to the site and is placed in the ground as per the prior art to form the manhole.

In an embodiment of the invention, the plug is sealed with a seal to prevent contamination of the plug during the fabrication of the casing and this represents a substantial advance in this art. The function and construction of the seal will become evident from the following description of the process although the method may be conducted using a plug without the seal, if desired.

Figure 5:
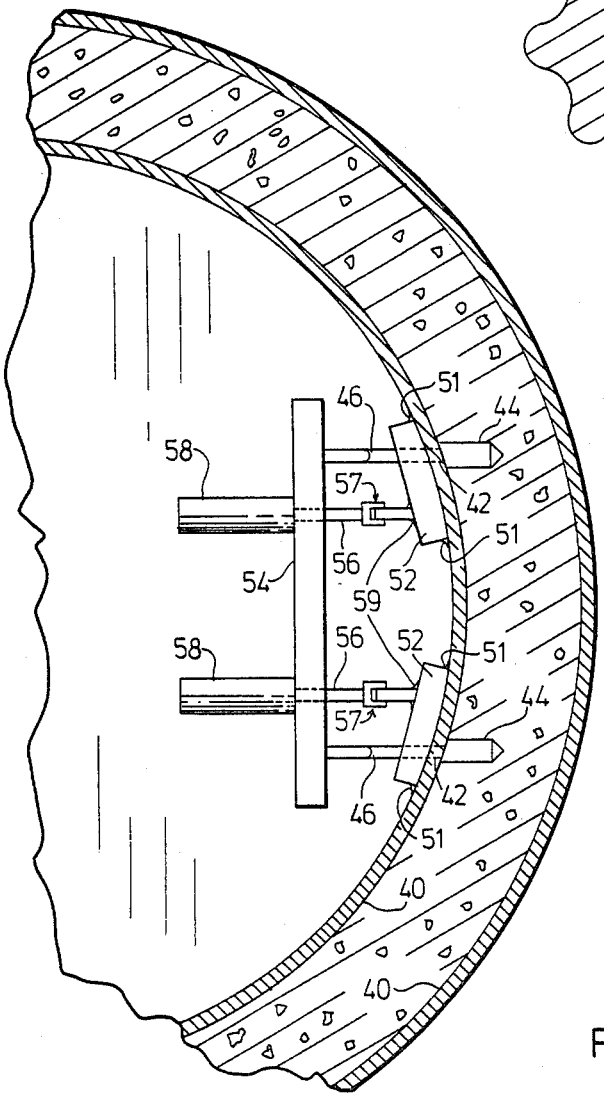
FIG. 5 is a schematic sectional top view of the manhole casing and arbor of the present invention used to install the novel plugs.

FIG. 5 shows an example of the construction of the device adapted to carry out the process of the present invention, in sectional top view with a cylindrical manhole casing.

Form 40 is constructed of the desired shape with a plurality of holes 42 therethrough. Each hole corresponds to the hole in the manhole casing in which the respective plug is to be inserted. The holes are usually in horizontally aligned pairs and each pair is vertically aligned to the adjacent pair of holes.

The method will now be explained with respect to a pair of horizontally-aligned holes. The process is done for each pair of holes at the same time using a plurality of fixtures, one fixture being used for each pair of holes.

The fixture used includes a pair of retractable arbors which are linked to a common levelling bar. The arbors are adapted to move through the holes in the form and this movement is controlled by the movement of the levelling bar. The movement of the levelling bar is controlled by a pair of pistons which are activated by an actuator.

Referring to FIG. 5, the arbors 46 are first extended through the form 40 through the holes 42 and the sealed plugs 44 are inserted on the ends of the arbors. The arbors 46 extend inwardly through a fixture plate 52 which is secured to the form 40 by fasteners 51 or by welding. The piston rod 56 is linked to the fixture plate 52 by rod 57 which is fastened to the plate 52 by fasteners 59 or by welding. Both the piston rod 56 and the arbor 46 are secured to the levelling bar 54 and piston rod 56 is controlled by actuator 58.

Figure 6:
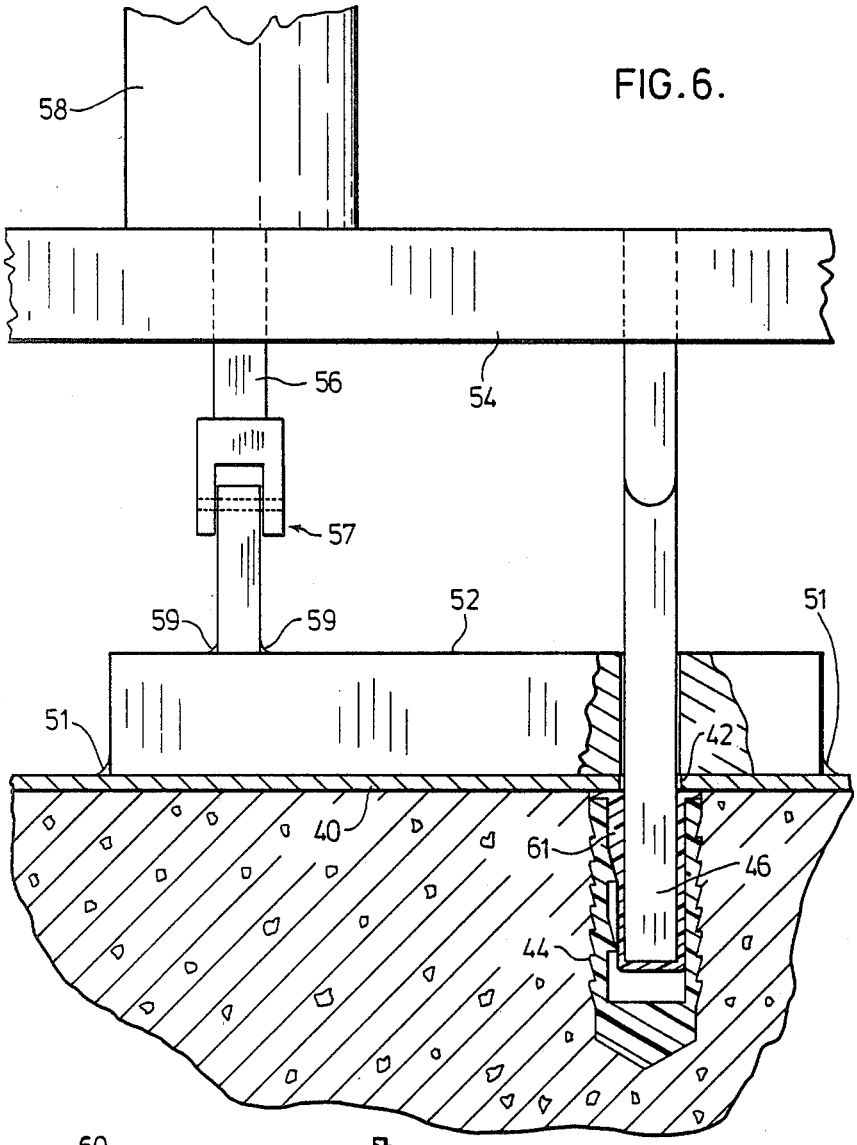
FIG. 6 is an enlarged view of a part of the arbor of FIG. 5.

Referring now to FIG. 6 for a more detailed explanation, FIG. 6 shows one-half of the fixture as shown in FIG. 5. The arbor 46 is inserted through the hole 42 in the form 40. Plug 44 is inserted on the end of the arbor 46 with the seal 61 inside the plug. The end of the sealed plug 44 is coplanar with the inner surface of form 40.

The fixture plate 52 is secured to the form 40 by fasteners 51 (or welding) or by any suitable means and the arbor 46 is movable through the fixture plate 52.

Arbor 46 is secured to the levelling bar 54 so that when the levelling bar moves inwardly or outwardly, the arbor is retracted or inserted through the fixture plate 52.

The actuator piston rod 56 is secured by fasteners 59 (or any other method) to the fixture plate 52 via rod 57, and at the other end, through levelling bar 54 to the actuator 58.

The actuator 58 may be actuated by air, hydraulic pressure or by manual means. When the actuator 58 is activated, the actuator piston rod 56 is extended thereby forcing the levelling bar 54 towards the centre of the form thereby retracting arbor 46. When the actuator 58 is actuated in the opposite direction, actuator piston rod 56 forces the levelling bar 54 towards form 40 thereby extending arbor 46 as shown in FIG. 6.

Once the fixture is assembled as shown in FIG. 6, the concrete is poured into the form 40 and compacted. After the concrete is compacted, the actuator 58 is activated thereby forcing the actuator piston rod 56 inwardly, and withdrawing arbor 46 through the hole 42, leaving the sealed plug in place. The sealed plug 44 cannot move with the arbor 46 since the width of the end of the plug 44 is wider than the hole 42 and is prevented from being withdrawn with the arbor 44 by fixture plate 52.

Thus, once the arbor 44 is fully withdrawn, the plug is retained in the concrete with the end of the plug 44 coplanar with the inside surface of the form 40.

The seal 61 is left in place until the arms of the step are to be inserted into the plug 44. The seal 61 keeps the interior of the plug clean and free of debris until the arms of the steps are inserted therein. One of the problems of the prior art methods is that the holes into which the arms of the steps are inserted, become contaminated with pieces of concrete or other debris. As shown in FIG. 6, the seal of the present invention fills the inside of the plug and prevents this from occurring.

Figure 7:
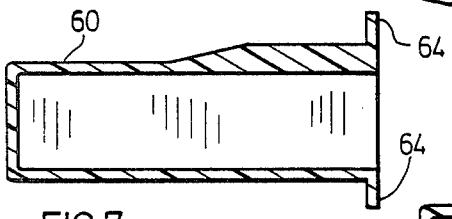
FIG. 7 is a side sectional view of a seal for use with the plug of the present invention.
Figure 8:
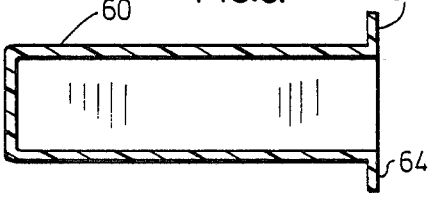
FIG. 8 is a side sectional view of another seal for use in the plug of the present invention.

The seals, two examples of which are shown in FIGS. 7 and 8, have a shape corresponding to the interior shape of the plug. The seals comprise a body 60 with lips 64 extending wider than the body 60. The seal forms a tight fit within the plug but may be easily pried off at the appropriate time.

The manhole casing having the sealed plugs inserted therein provides distinct advantages over the prior art. In particular, the plugs are securely held in the manhole casing and cannot be extracted. Swedging has been eliminated and a safe assembly is ensured. Also, the plugs are sealed thereby preventing any contamination prior to use.

A further advantage of this invention is that not all the plugs need be used. For example, if the installer wishes to use only certain plugs, the remainder of the plugs are left sealed and may be used at a subsequent time or not at all.

The present invention also provides a novel plug which is particularly advantageous over the prior art plugs. As shown in FIGS. 9*a*, 9*b* and 9*c*, the outside of the plug may be of varied configuration. It has a cylindrically shaped body 66 with a conical tip 68, for ease of insertion.

The exterior surface of the plug is sculptured to increase the holding strength of the plug within the concrete and may be of varied configurations. As shown in FIG. 9(*a*), the sculptured surface may have a buttress thread 70 which has a series of preferred nominal major diameters and a series of preferred pitches. The specific combination of the preferred diameters and pitches of the buttress thread is a matter of choice for one skilled in the art.

The sculptured exterior surface of the plug may also have a wave pattern as shown in FIG. 9(*b*) or a labyrinth configuration as shown in FIG. 9(*c*) which has a plurality of ridges 84 and depressions 86 therein.

The preferred plug is made of a suitable plastic material which is corrosion resistant and yieldable to allow for easy handling.

The interior shape of the plug corresponds to the cross-section of the arm of the step. For example, the plug may have a rectangular inside shape or a circular one (in cross-section) depending upon the shape of the arm of the step to be inserted therein.

Figure 11:
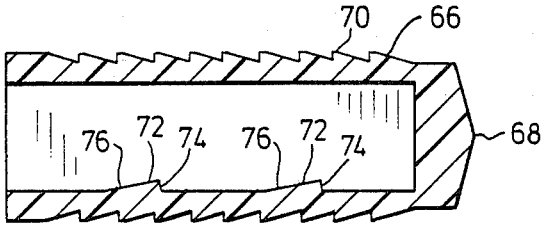
FIG. 11 is a side sectional view of the plug of FIG. 9(*a*).

The inside of the plug has a novel configuration which effectively locks the arm of the step inside the plug. The inside surface of the plug carries thereon, one or more ridges 72 as shown in FIG. 11. Each ridge has a lock surface 74 and a lead surface 76. The lock surface is substantially perpendicular while the lead surface slopes gently rearwardly.

Figure 12:
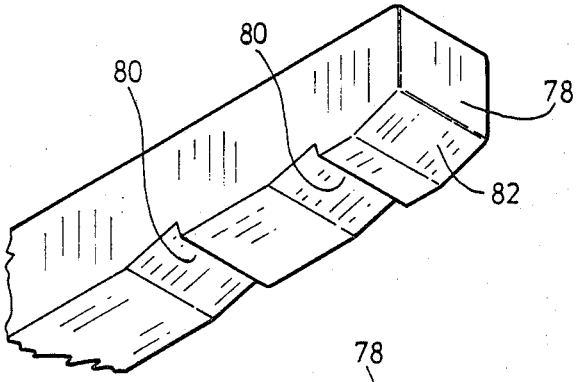
FIG. 12 is a side view of an arm of the step of the present invention.
Figure 13:
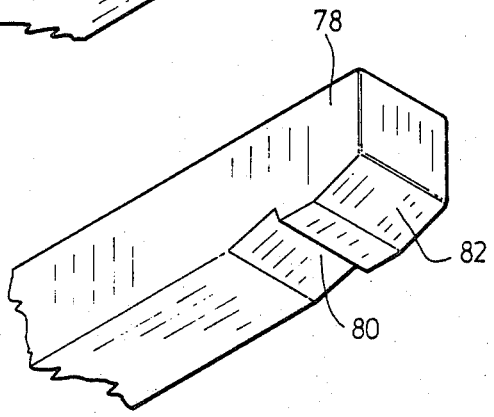
FIG. 13 is a side view of an arm of a step of another embodiment of the invention.
Figure 14:
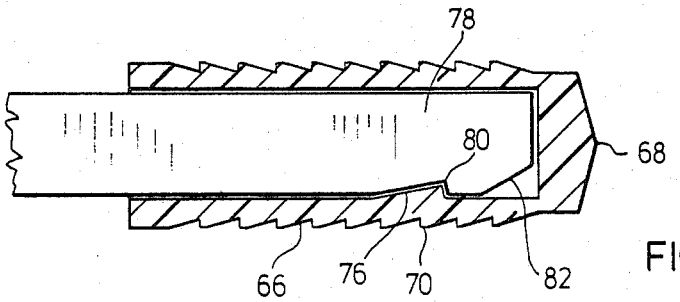
FIG. 14 is a side sectional view of an arm and plug of the FIGS. 9(*a*) and 13.

As shown in FIGS. 12 to 14, the arm 78 of the step carries on one surface thereof, a notch 80 corresponding to the ridge 72. The leading edge 82 is truncated which allows for easy insertion of the arm 78 into the plug 44.

To insert the arm 78 into the plug 44, the arm 78 is forced into the plug until the notch 80 engages the ridge 72 as shown in FIG. 14. A slight expansion of the plug 44 occurs as the leading edge 82 is forced over the ridge 72 but this is easily accommodated as the plug 44 is yieldable to this extent. Once inserted, the arm 78 is held securely in place and cannot be removed.

The arm 78 may have one or more notches cut therein and the number will correspond to the number of ridges 72 in the plug 44.

As will be appreciated, it is necessary that the plug 44 be inserted on the end of the arbor 46 in the proper orientation so that the locking means of the arm as shown in FIGS. 12 and 13, correspond to the locking means of the plug 44 as shown in FIG. 11. In order to ensure this, the arbors and the plugs are provided with a positive lock, three examples of which are shown in FIGS. 10*a*, 10*b* and 10*c* in end view.

In FIG. 10(*a*), there is shown the end of an arbor which has one corner thereof, truncated. The plug carries a corresponding protrusion on its inner surface. Thus, when the operator is ready to install the plug on the end of the arbor, the plug may only be inserted on the end of the arbor (in FIG. 6) in the correct orientation. Otherwise, the plug will not fit on the end of the arbor. It is necessary to assemble the plug on the arbor in the proper orientation so that when the step is inserted into the plug, the locking means are properly orientated as well.

Two other embodiments are shown in FIGS. 10(*b*) and 10(*c*). In each of these embodiments, the arbor is of a rectangular shape with a corner cut-away. Thus, when the operator installs the plug on the end of the arbor, he can place the plug on the arbor in the correct fashion for the subsequent insertion of the arms of the step. With each of these embodiments, the plug (and seal) would carry a complimentary protrusion on the inside surface thereof which in conjunction with the complimentary shape, enables the operator to correctly assembly the device. These embodiments are only shown for illustrative purposes and any suitable orientation method could be adopted.

Although the disclosure describes and illustrates a preferred embodiment of the invention, it is to be understood the invention is not restricted to this particular embodiment.

What I claim is:

1. A method of manufacturing a concrete manhole casing comprising:

(a) fabricating a form of a predetermined shape;

(b) securing a plurality of retractable arbors on the inside surface of said form, each arbor located on the surface of said form at a predetermined location;

(c) extending each arbor through said form;

(d) placing a plug on the end of each arbor;

(e) pouring concrete into said form;

(f) vibrating and compacting said poured concrete;

(g) retracting said arbors leaving said plugs in said compacted concrete; and (h) removing said form and arbors.

2. A method as claimed in claim 1 wherein said form is circular in cross-section.

3. A method as claimed in claim 1 wherein said form is rectangular in cross-section.

4. A method as claimed in claim 1 wherein a pair of arbors are horizontally aligned on the inside of said form in a spaced relation to each other.

5. A method as claimed in claim 4 wherein a plurality of pairs of arbors are vertically aligned along the vertical axis of said manhole casing.

6. A method as claimed in claim 1 wherein one end of the plug is coplanar with the inside surface of the manhole casing when the form is removed.

7. A method as claimed in claim 1 wherein said plug carries a seal therein and said sealed plug is placed on the end of each arbor.

8. A method as claimed in claim 6 wherein said plug carries a seal therein and the end of said sealed plug is coplanar with the inside surface of said casing when the form is removed.

9. A method of constructing a manhole comprising:

(a) prefabricating a manhole casing, said prefabrication comprising the steps of:

(i) fabricating a form of a predetermined shape;

(ii) securing a plurality of retractable arbors on the inside surface of said form, each arbor located on the surface of said form at a predetermined location;

(iii) extending each arbor through said form;

(iv) placing a sealed plug on the end of each arbor;

(v) pouring concrete into said form;

(vi) vibrating and compacting said poured concrete;

(vii) retracting said arbors leaving said sealed plugs in said compacted concrete; and (viii) removing said form and arbors;

(b) transporting said prefabricated casing to a job site;

(c) inserting said casing into the ground at a predetermined position; and (d) back filling earth around said casing to secure said manhole casing in the ground.

10. A method as claimed in claim 9 further including the steps of removing the seals from the predetermined number and selection of plugs and inserting one arm of a safety step in each of said plugs.

11. A method of manufacturing a concrete manhole casing comprising:

(a) fabricating a form of a predetermined shape;

(b) securing a plurality of retractable arbors on the inside surface of said form, each arbor located on the surface of said form at a predetermined location;

(c) extending each arbor through said form;

(d) placing a plug on the end of each arbor, said plug comprising an elongated body of yieldable plastic having a conical tip and a hollowed interior with a locking means on the interior surface of said plug;

(e) pouring concrete into said form;

(f) vibrating and compacting said poured concrete;

(g) retracting said arbors leaving said plugs in said compacted concrete; and (h) removing said form and arbors.

12. A method of manufacturing a concrete manhole casing comprising:

(a) fabricating a form of a predetermined shape;

(b) securing a plurality of retractable arbors on the inside surface of said form, each arbor located on the surface of said form at a predetermined location;

(c) extending said arbor through said form;

(d) placing a sealed plug on the end of each arbor, said plug comprising an elongated body of yieldable plastic having a conical tip and a hollowed interior with a locking means on the interior surface of said plug, said locking means including a ridge having a lock surface and a lead surface;

(e) pouring concrete into said form;

(f) vibrating and compacting said poured concrete;

(g) retracting said arbors leaving said plugs in said compacted concrete; and (h) removing said form and arbors.

* * * * *